US006086253A

United States Patent [19]

Hartsfield

[11] Patent Number: 6,086,253

[45] Date of Patent: Jul. 11, 2000

[54] BAG FOR STORING AND DISPENSING BAGS

[76] Inventor: Adeline R. Hartsfield, P.O. Box 680577, San Antonio, Tex. 78268-0577

[21] Appl. No.: 09/148,871

[22] Filed: Sep. 8, 1998

Related U.S. Application Data

[63] Continuation-in-part of application No. 08/847,586, Apr. 24, 1997, abandoned.

[51] Int. Cl.[7] ..... B65D 35/14

[52] U.S. Cl. ..... 383/22; 383/24; 383/27; 383/41; 383/67; 383/71; 383/75

[58] Field of Search ..... 383/71, 72, 75, 383/22, 27, 28, 24, 67, 41

[56] References Cited

U.S. PATENT DOCUMENTS

| | | | |
|---|---|---|---|
| 558,022 | 4/1896 | Aspden | 383/67 |
| 1,383,955 | 7/1921 | Kiley | 383/67 |
| 4,785,934 | 11/1988 | Hogle | 383/67 X |
| 4,882,794 | 11/1989 | Stewart, III . | |
| 4,986,681 | 1/1991 | Oliver . | |
| 5,009,516 | 4/1991 | Geeck . | |
| 5,288,150 | 2/1994 | Bearman | 383/62 X |
| 5,323,802 | 6/1994 | Kiedrowski | 383/75 X |
| 5,341,933 | 8/1994 | Willows . | |
| 5,451,108 | 9/1995 | Anderson . | |
| 5,462,378 | 10/1995 | Webb . | |
| 5,535,543 | 7/1996 | Alexander . | |
| 5,692,836 | 12/1997 | Mitchell | 383/22 X |
| 5,743,458 | 4/1998 | French | 383/67 X |
| 5,839,631 | 11/1998 | Hebert et al. | 383/72 X |

FOREIGN PATENT DOCUMENTS

| | | | |
|---|---|---|---|
| 541519 | 8/1959 | Belgium | 383/75 |
| 440953 | 2/1927 | Germany | 383/41 |
| 2268157A | 1/1994 | United Kingdom . | |

*Primary Examiner*—Allan N. Shoap
*Assistant Examiner*—Robin A. Hylton
*Attorney, Agent, or Firm*—Terrance L. Siemens

[57] ABSTRACT

A bag for storing and dispensing flexible bags. The bag has an upper opening closed by a drawstring and a lower opening closed by an elastic gather. The drawstring is enclosed within a hem. The drawstring is partially exposed so that it may be draped over a hook or the like, thereby suspending the bag from an environmental surface. The gather comprises an elastic band stitched to the bag either by passing stitches through the elastic band or such that the stitches surround and entrap the band without penetrating it. The novel bag is fabricated by placing the drawstring and the gather at opposite, parallel ends of a spread out panel of flexible fabric. The ends are folded over to enclose the drawstring, and are adhered, welded, or otherwise secured in this fashion. The remaining two opposed edges are then joined, thereby reconfiguring the rectangular panel as a cylinder, with one open end encircled by the drawstring and the other open end closed by the gather. The drawstring, if assembled to the novel bag in linear form, is then joined at its ends to form a closed loop.

1 Claim, 2 Drawing Sheets

BAG FOR STORING AND DISPENSING BAGS

REFERENCE TO RELATED APPLICATION

This application is a Continuation-In-Part of Ser. No. 08/847,586, filed Apr. 24, 1997, now abandoned.

BACKGROUND OF THE INVENTION

1. FIELD OF THE INVENTION

The present invention relates to a bag adapted for compact storage of and dispensing of flexible bags, and to a method of fabricating the novel bag. The bag is open at both ends, one end having a draw string and the other end being gathered by a strip of elastic material.

2. DESCRIPTION OF THE PRIOR ART

Consumers frequently retain for subsequent reuse bags obtained at the point of sale for enclosing and transporting retail purchases. These bags are typically flexible and collapsible, many being fabricated from thin yet strong sheets of synthetic resin. Reused bags are useful if maintained in reasonably clean condition, kept together in a known location, and readily dispensed.

Such used bags have little mass, yet will occupy a considerable volume if not contained within a container which is capable of either compressing used bags, or at a minimum, of restraining them from naturally opening or spreading to assume their natural volume when not compressed or folded.

The prior art has suggested devices for storing and dispensing bags for reuse. Examples are seen in U.S. Pat. No. 5,341,933, issued to Barry L. Willows on Aug. 30, 1994, and U.S. Pat. No. 5,451,108, issued to Bruce Anderson on Sep. 19, 1995, and U.K. Patent Application Number 2,268, 157A, dated Jan. 5, 1994. These references illustrate generally cylindrical bags open at the top and at the bottom, with a drawcord at the top and elastic at the bottom for constricting the upper and lower openings. However, in each case, the elastic is contained in a closed, hollow hem. By contrast, the present invention sets forth a construction eliminating the hem.

The invention also comprises a method of forming the novel bag. None of the above patents teaches the novel method of forming the novel bag.

None of the above inventions and patents, taken either singly or in combination, is seen to describe the instant invention as claimed.

SUMMARY OF THE INVENTION

The present invention provides a bag uniquely suited for storing and dispensing flexible bags. The novel bag has an upper opening for receiving bags for storage and a lower opening for dispensing stored bags. The upper opening has a drawstring for partially closing the bag, and for suspending the bag from a hook or other environmental projecting object. The drawstring preferably forms a closed loop, which is convenient for engaging hooks and the like. The lower opening has an elastic gather for urging the lower opening to close resiliently as much as is permitted by resistance of stored bags.

Both upper and lower openings are therefore variable in configuration and dimension. Both configuration and dimension of the upper and lower openings are responsive to volume of and pressure exerted by stored bags. The upper opening may be drawn closed over stored bags, but once pulling force acting on the drawstring is relaxed, no further constriction of the opening occurs. The lower opening is elastically biased to remain closed. The central body of the novel bag, being itself flexible, also varies in configuration and dimensions responsive to bags inserted and stored therein, although is not elastic or resilient.

The upper opening is larger than the lower opening, since gravity will assist in retaining stored bags. It is advantageous that the upper opening be sufficiently large as to cooperate with insertion of a person's hand. The lower opening is preferably small, so that bags are obstructed from falling through the lower opening and thereby escaping.

The user inserts bags into the upper opening for storage in a crumpled or folded condition. Stored bags are retained since the upper opening is somewhat restricted by the weight of the novel bag and its stored contents, as this weight acts on the drawstring to a slight degree. The lower opening expands resiliently around the hand of the user when the user inserts his hand into the bag to retrieve a stored bag.

The novel bag occupies less space than does a container having such rigidity as to hold its shape despite potentially being filled with bags. The novel bag is lighter and more compact when not filled to or near capacity, and is more compactly stored when not in use. Flexibility also substantially reduces chances of damage or injury should the novel bag be dropped, compared to rigid containers.

The novel method employs a rectangular sheet of suitable material, onto which are placed the drawstring and the elastic gather. The open rectangular sheet is folded over the drawstring and is secured so as to form a hem. Securement may be by stitching, adhering, sonic or thermal welding, or by any other suitable method. An elastic band is laid over the open sheet, held stretched thereon, and stitched thereto. Stitches may either penetrate the elastic band and pin the same to the sheet, or alternatively may cross and entrap the elastic band.

The sheet, still rectangular, is then folded over onto itself so that two formerly opposing edges meet. The edges are then secured to one another by a method which may be the same as that for forming the hems. The stretched elastic spontaneously contracts, thereby forming a pleated gather at the lower opening of the bag. This gather is readily stretched to accommodate insertion of a person's hand to retrieve a stored bag.

Accordingly, it is a principal object of the invention to provide a flexible container for storing and dispensing flexible bags.

It is another object of the invention to provide the flexible container with an upper opening for insertion of bags for storage, and a lower opening for retrieval of stored bags.

It is a further object of the invention to provide a drawstring for partially closing the upper opening.

Still another object of the invention is to provide a resilient member for resiliently closing the lower opening.

It is an object of the invention to secure an elastic member to the lower opening without forming a closed hem.

An additional object of the invention is to provide a member suitable for engaging hooks and other projecting environmental objects, for suspending the novel bag.

It is a further object of the invention to provide a method for fabricating a bag from flat stock material, which bag has an upper opening having an encircling drawstring and a lower opening having a constricting gather.

Yet another object of the invention is that the lower opening be smaller in diameter than the upper opening.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
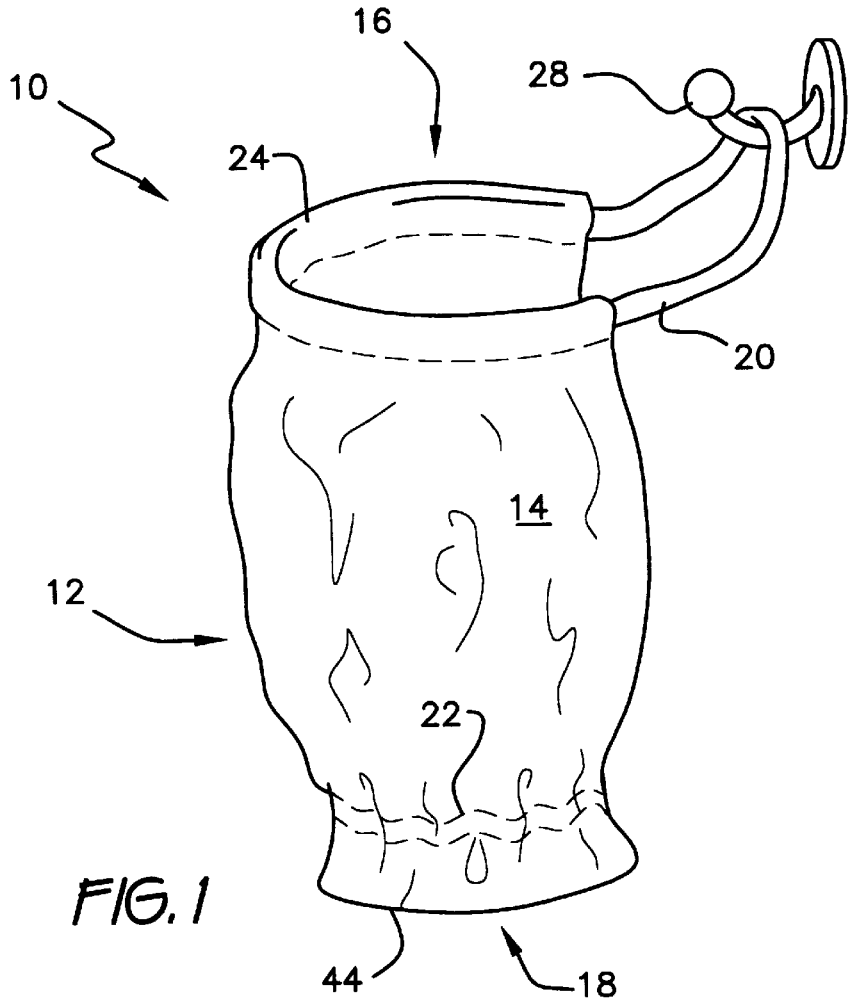
FIG. 1 is a front perspective view of the invention.

Turning now to FIG. 1 of the drawings, the novel bag 10 is seen to comprise a flexible central body 12 having a circumferential wall 14, an upper opening 16, and a lower opening 18. A flexible tie 20, which serves as a drawstring, encircles circumferential wall 14 at upper opening 16. Flexible tie 20 will constrict circumferential wall 14 at upper opening 16 when pulled.

An elastic band 22 encircles circumferential wall 14 at lower opening 18. Elastic band is dimensioned and configured to have a diameter less than that of lower opening 18. Therefore, band 22 is resiliently biased to spontaneously exert a constant constricting force on circumferential wall 14 at lower opening 18.

By contrast, first flexible tie 20 has a length greater than that of the circumference of bag 10 at upper opening 16. Therefore, first flexible tie 20 has sufficient length to project from bag 10.

Flexible tie 20 is substantially enclosed by and retained within a hem 24. Tie 20 forms a closed loop. Its associated hem 24 is partially open, thereby exposing flexible tie 20 along a portion of its length. This characteristic of bag 10 enables tie 20 to engage a projecting environmental object, such as hook 28, for purposes of suspending bag 10.

Figure 2:
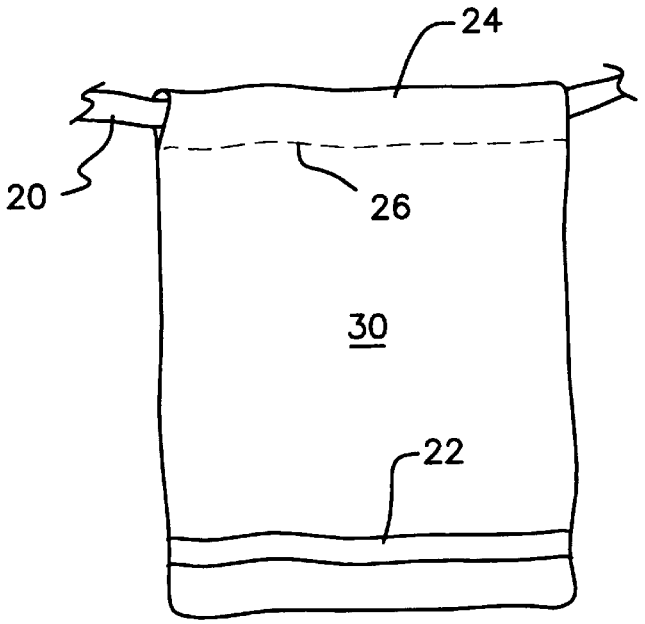
FIG. 2 is a plan view of the unassembled invention, illustrating initial steps of assembly from a flat sheet of fabric.

As shown in FIG. 2, hem 24 is formed in any suitable way, such as by folding over fabric panel 30 which will become circumferential wall 14, and stitching as indicated at 26. Elastic band 22 is attached to panel 30 by a different method wherein band 22 is stitched directly to panel 30 and hence to circumferential wall 14 after completion of bag 10. No structure other than stitches 32 secure elastic band 22 to panel 30.

Figure 3:
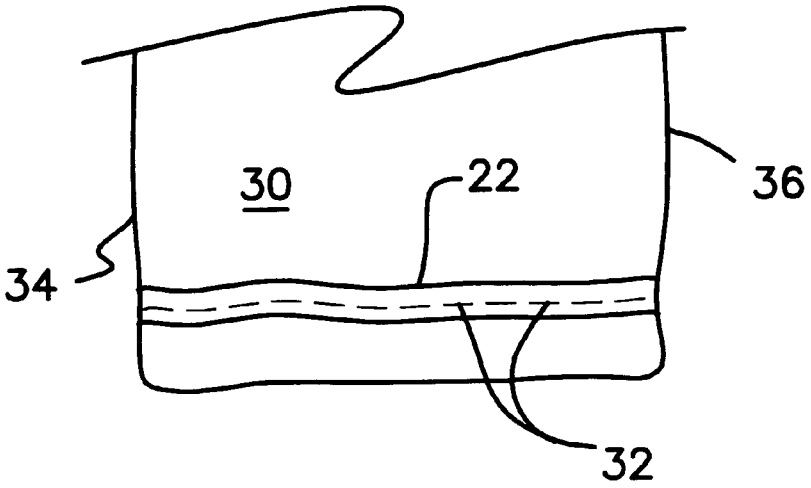
FIG. 3 is a detail view of FIG. 2, showing a stitch employed in one embodiment of the invention.

As shown in FIG. 3, in one embodiment of the invention, stitches 32 penetrate band 22 and pin band 22 directly to fabric panel 30. Band 22 is laid out on panel 30 and held stretched out beyond its normal length, so that it will contract and gather panel 30 when grasp of elastic band 22 is relinquished. Stitches 32 are oriented longitudinally in the direction of stretch of elastic bad 22. Opposing edges 34, 36 of panel 30 may then be joined to form the generally cylindrical sleeve depicted in FIG. 1.

Figure 4:
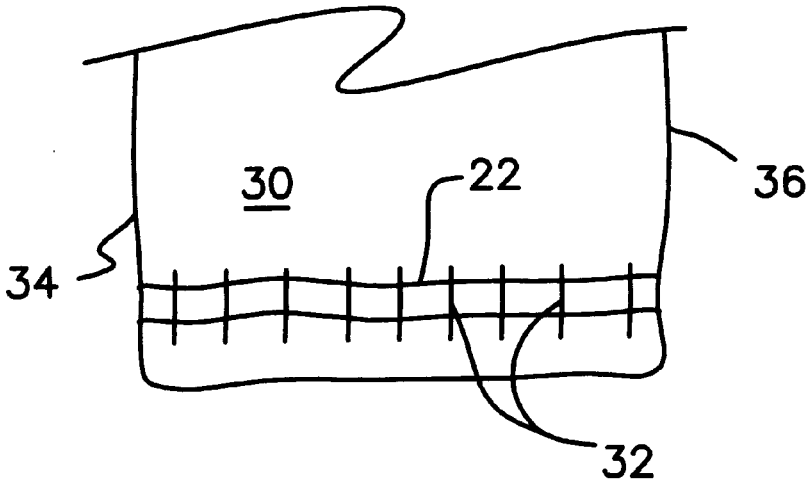
FIG. 4 is a detail view similar to FIG. 3, but showing a stitch employed in a second embodiment of the invention.

In an alternative embodiment, referring now to FIG. 4, elastic band 22 is surrounded by and entrapped within stitches 38 which pass over but do not penetrate band 22. Stitches 38 pass through panel 30 and are anchored therein, thus establishing an open mesh which retains band 22 in place. Ends 40, 42 of band 22 are fixed in any suitable way to panel 30, if required to prevent contraction from withdrawing band 22 from engagement with individual stitches 38. Bag 10 may then be closed by joining edges 34, 36.

It will be seen from FIG. 1 that when band 22 is suitably stitched to circumferential wall 14, wall 14 flares outwardly at its lowermost end, band 22 causing a narrow waist to be formed well above bottom edge 44 of bag 10. The flared end assists in guiding a user's hand into constricted opening 18 when retrieving a bag (not shown) or other article stored in bag 10. The flared end forms a skirt depending from the narrow waist, wherein the skirt is flared and opens away from the narrow waist.

The novel bag is preferably formed from a fabric imprinted with decorative indicia. Likewise, tie 20 may be colored or otherwise decorated.

The present invention is susceptible to various modifications which may be introduced by those skilled in the art. For example, the body of the novel bag need not be precisely cylindrical, nor unassembled panel 30 be rectangular in plan view. Proportions and dimensions of the novel bag may be adjusted to suit individual preferences.

Tie 20 may, if desired, not form a closed loop, if it is desired to present free ends (not shown) for grasping. Elastic band 22 may optionally be enclosed in a hem (not shown) formed at lower opening 18 to protect band 22 or for aesthetic effect, if desired.

Thus, there is provided a bag 10 having a closable upper opening 16 and a closable lower opening 18. Bag 10 is suitable for receiving, storing, and dispensing other flexible bags, rags and napkins, gloves and scarves, and like articles formed from fabrics and other webs of flexible material.

It is to be understood that the present invention is not limited to the embodiments described above, but encompasses any and all embodiments within the scope of the following claims.

I claim:

1. A bag for storing and dispensing flexible bags, comprising:

a flexible central body having a circumferential wall, an upper opening, and a lower opening;

a flexible tie encircling said circumferential wall at said upper opening, said flexible tie disposed to constrict said circumferential wall at said upper opening when pulled, said circumferential wall further comprising a hem formed at said upper opening, said hem disposed to enclose and retain said flexible tie, wherein said flexible tie forms a closed loop, and said bag is configured to expose said flexible tie along a portion of the length of said flexible tie, whereby said flexible tie may engage a projecting environmental object for purposes of suspending said bag;

an elastic band encircling said circumferential wall at said lower opening, said elastic band disposed proximate said lower opening and disposed to constrict said circumferential wall at said lower opening; and stitches directly securing said elastic band to said circumferential wall, wherein said stitches are oriented longitudinally in the direction of stretch of said elastic band and pass through said elastic band and pin said elastic band to said circumferential wall, and said circumferential wall has a narrow waist formed therein where said elastic band contacts said circumferential wall, and said circumferential wall has a skirt depending from said narrow waist, wherein said skirt is flared and opens away from said narrow waist.

* * * * *